US008783520B2

(12) United States Patent
Hagleitner

(10) Patent No.: US 8,783,520 B2
(45) Date of Patent: Jul. 22, 2014

(54) DISPENSER

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 0 days.

(21) Appl. No.: 13/658,010

(22) Filed: Oct. 23, 2012

(65) Prior Publication Data

US 2013/0043279 A1 Feb. 21, 2013

Related U.S. Application Data

(63) Continuation of application No. PCT/AT2011/002013, filed on Apr. 21, 2011.

(30) Foreign Application Priority Data

Apr. 23, 2010 (AT) ..... A 667/2010

(51) Int. Cl.
*B65D 37/00* (2006.01)

(52) U.S. Cl.
USPC ..... 222/207; 222/181.1; 222/181.3; 222/182; 222/212; 222/213; 222/325; 222/494; 222/631

(58) Field of Classification Search
USPC ..... 222/181.1–181.3, 183, 180, 173, 207, 222/209, 212–215, 380, 630–633, 325, 372, 222/490, 494; 137/512, 512.2, 512.4
See application file for complete search history.

(56) References Cited

U.S. PATENT DOCUMENTS

| | | | | |
|---|---|---|---|---|
| 2,772,817 | A | 12/1956 | Jauch | |
| 4,673,109 | A * | 6/1987 | Cassia | 222/153.03 |
| 4,886,192 | A * | 12/1989 | Cassia | 222/181.2 |
| 4,964,544 | A * | 10/1990 | Hanna et al. | 222/181.2 |
| 4,978,036 | A * | 12/1990 | Burd | 222/207 |
| 5,810,203 | A * | 9/1998 | Brennan | 222/207 |
| 5,906,299 | A * | 5/1999 | Hagleitner | 222/190 |
| 6,053,370 | A * | 4/2000 | Ludbrook et al. | 222/207 |
| 7,748,574 | B2 | 7/2010 | Ophardt et al. | |
| 7,798,371 | B2 | 9/2010 | Ophardt | |
| 7,992,804 | B2 | 8/2011 | Nauels | |
| 8,596,501 | B2 * | 12/2013 | Hagleitner | 222/207 |

FOREIGN PATENT DOCUMENTS

| | | |
|---|---|---|
| DE | 10 2005 038 247 A1 | 5/2006 |
| DE | 10 2005 006 845 A1 | 8/2006 |
| EP | 1 927 307 A2 | 6/2008 |

* cited by examiner

*Primary Examiner* — Frederick C Nicolas
(74) *Attorney, Agent, or Firm* — Laurence A. Greenberg; Werner H. Stemer; Ralph E. Locher

(57) ABSTRACT

A dispenser for a liquid or pasty media contains an exchangeable container which is arranged upside down on a holder. A dosing pump is provided on the bottom of the container in an especially non-detachable manner, and an actuating element for the dosing pump is provided on the holder retainer. A first return valve is provided at an upper inlet to the dosing pump and a second return valve at its lower dispensing opening which second return valve can be lifted, thereby reducing the delivery space. The actuating element is displaceably mounted in the retainer and has a ramp displacing a catch guided upwards by the retainer, the catch being associated with the lower return valve.

6 Claims, 4 Drawing Sheets

DISPENSER

CROSS-REFERENCE TO RELATED APPLICATION

This application is a continuation, under 35 U.S.C. §120, of copending international application No. PCT/AT2011/000203, filed Apr. 21, 2011, which designated the United States; this application also claims the priority, under 35 U.S.C. §119, of Austrian patent application No. AT A667/2010, filed Apr. 23, 2010; the prior applications are herewith incorporated by reference in their entireties.

BACKGROUND OF THE INVENTION

Field of the Invention

The invention relates to a dispenser for a liquid or pasty media, having an exchangeable container, which is arranged in an upended state and on the underside of which a metering pump is provided, in particular in a non-releasable manner. The dispenser has a holder for the container and an actuating element for the metering pump is provided on the holder. A first non-return valve is provided at the upper inlet into the metering pump and a second non-return valve is provided at the dispensing opening at the bottom of the metering pump, it being possible for the second non-return valve to be raised to reduce the size of the delivery chamber.

The medium which has been introduced in such a container may be of any desired type, in particular media from the sanitary or hygiene sector, for example soap, shampoo, cream, disinfectant or the like, wherein the type of medium is merely of secondary importance. It is possible for the container and pump, once emptied, to be thrown away together, and therefore a new, filled container is also accompanied by a new pump. This has the advantage that the pump does not require any maintenance.

Suitable dispensers are known in a number of embodiments, and the metering pumps, which can be actuated by hand or by motor, have a pump chamber, of which the volume can be reduced in size, wherein the two non-return valves act alternately. The pump chamber, in the rest position, is filled with the medium and—as soon as the pump is actuated—a portion is pushed out through the lower non-return valve, whereas the upper valve prevents return into the container. If the actuating element is reset, then the lower valve closes and prevents air from entering, whereas the upper valve opens and takes medium into the pump chamber. If the container is not compressible, then air has to be able to flow into the container.

A metering pump which can be actuated by hand should have the actuating element at a conveniently accessible location on the front side, in the vicinity of the dispensing opening of the metering pump, so that the medium is dispensed into the open hand which is carrying out the pumping action.

The more or less horizontal actuating device which is advantageous for this purpose therefore has to be transferred into the vertical lifting movement, for which purpose it is known, for example from German patent DE 10 2005 006 845, corresponding to U.S. Pat. No. 7,992,804, to use an angle lever which can be pivoted about a front axis and of which the vertical limb is pivoted rearward, wherein the horizontal limb compresses the pump. Of course, the lifting movement is non-linear, and the forces thus act on the pump from different directions.

SUMMARY OF THE INVENTION

It is an object of the invention, then, to find a further solution, which is as straightforward as possible and does not have the aforementioned disadvantages, this being achieved in that the actuating element is arranged in a displaceable manner in the holder and has a ramp, and in that the lower non-return valve is assigned a driver, which is guided upward in the holder and can be shifted by the ramp.

With the foregoing and other objects in view there is provided, in accordance with the invention a dispenser for a liquid media or a pasty media. The dispenser contains a metering pump having an upper inlet, a bottom with a dispensing opening, and a delivery chamber. An exchangeable container is disposed in an upended state and has an underside and on which underside the metering pump is disposed. A holder is provided for the exchangeable container. An actuating element is provide for the metering pump and is disposed on the holder. The actuating element is disposed in a displaceable manner in the holder and has a ramp. A first non-return valve is disposed at the upper inlet into the metering pump and a driver is provided. A second non-return valve is disposed at the dispensing opening at the bottom of the metering pump. It is possible for the second non-return valve to be raised to reduce a size of the delivery chamber, the second non-return valve being assigned the driver. The driver is guided upward in the holder and can be shifted by the ramp.

In this way, the more or less horizontal movement by which the hand is advanced up to the dispenser is incorporated in the pump-actuating movement and converted into a vertical lifting movement, from which non-vertical force components act only on the holder, but not on the metering pump.

In a preferred embodiment, it is provided that the driver is formed by a lower annular flange of a sleeve, which is guided in a displaceable manner in the holder and acts on the metering pump around the lower non-return valve.

The delivery chamber of the metering pump is preferably enclosed by a folding bellows, which is formed in one piece with the lower non-return valve, this resulting in a particularly straightforward cost-effective solution which makes it possible to dispose of the metering pump along with the emptied container and replace the same with a new unit.

It is also in the case of using a folding bellows as a compressible pump chamber that it is advantageous if, upon actuation of the pump, the folding bellows is subjected to forces which act only in the compression direction, and there is therefore no need for any lateral stiffening devices or supports.

It is exclusively in the abutment region of the annular flange of the driver sleeve against the folding bellows that an inner stiffening ring of the folding bellows is therefore advantageous. This ring, at the same time, also supports the non-return valve of the dispensing opening, the valve preferably forming a self-closing push-out valve, of which the exit opening is slotted, in particular has cross-slots.

The dispenser according to the invention is thus made up of just three elements, that is to say from the holder, the vertically displaceable driver and the actuating element, which is preferably arranged such that it can be displaced in a drawer-like manner, and extends approximately over the entire width of the holder.

The holder can be fastened directly on a wall, and there is no need for either a housing or a covering if the container is stiff, i.e. cannot be compressed by the external air pressure, since it may then also be configured d in an esthetically pleasing manner.

In the holder, the container is plugged in and locked, for example in the manner of a bayonet closure, in an upended state with the metering pump attached to the neck.

In order to arrange the container in the correct position in the dispenser, markings or coding elements are preferably provided in the neck region, these interacting with counterpart elements on the opening of the holder. As a result, once the refill unit has been inserted into the dispenser, this allows information which may be provided on the container, for example details relating to the contents etc., to be located on the rear side of the container, rather than in direct view of the person looking at it.

Other features which are considered as characteristic for the invention are set forth in the appended claims.

Although the invention is illustrated and described herein as embodied in a dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
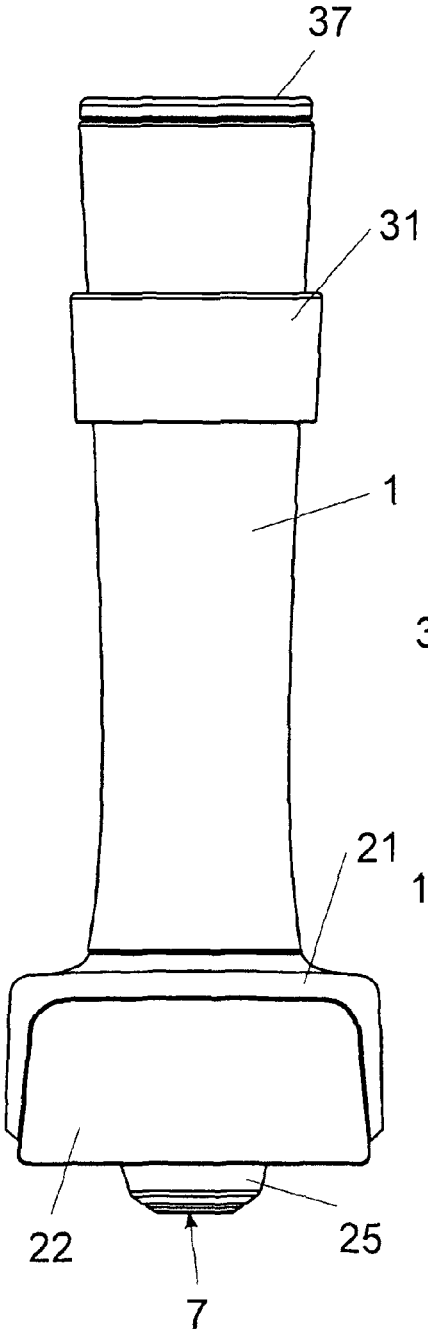
FIG. 1 is a diagrammatic, front view of a dispenser with a container inserted therein according to the invention.
Figure 2:
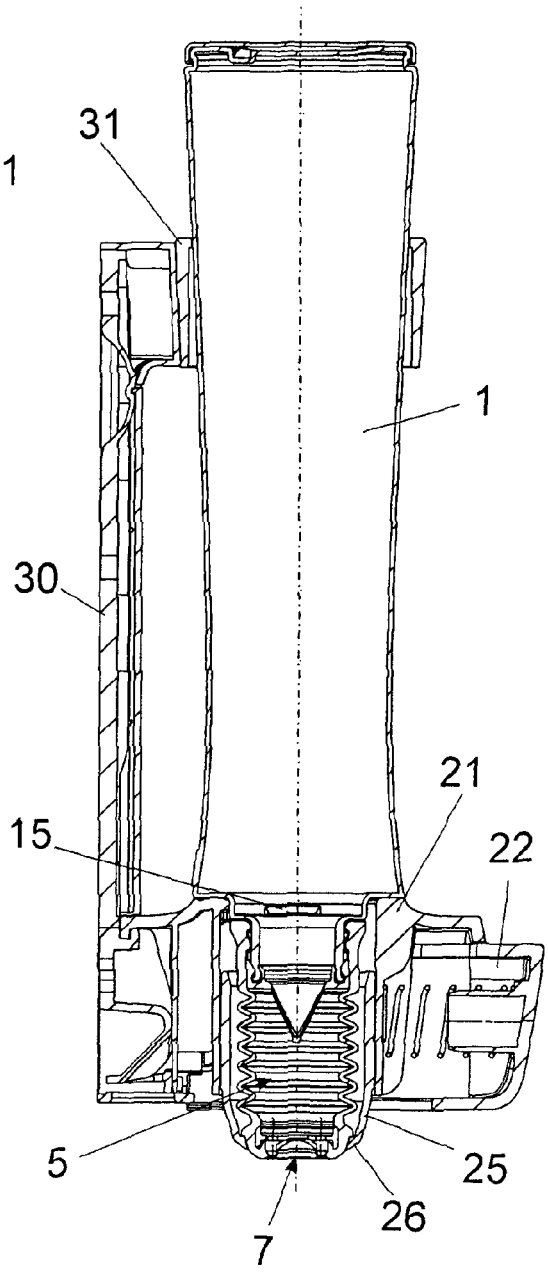
FIG. 2 is a diagrammatic, vertical sectional view through the dispenser with the container.

Referring now to the figures of the drawing in detail and first, particularly, to FIG. 1 thereof, there is shown a refill unit for a dispenser for dispensing a liquid or pasty medium. The refill unit includes a stiff container 1 which can have air admitted into it and has a neck 2, with at least two circumferential ribs 3, 4, and also has a metering pump 5, which is arranged on the neck 2. The metering pump 5 is made up of two parts 11, 16 made of elastic material, wherein a first non-return valve 6 is formed in one piece with the first part 11, the non-return valve being provided at the transition from the neck 2 into the delivery chamber 20 of the metering pump 5. The first part 11 has a ring or a bead 13 engaging around at least the lowermost circumferential rib 4 and is provided with an annular sealing lip 12, which pushes against the inner surface of the neck 2.

A second, push-in non-return valve 8 is formed in one piece with the second part 16 of the metering pump 5, the second non-return valve closing the dispensing opening 7 of the metering pump 5. The central region of the second part 16, the central region enclosing the delivery chamber 20, is provided in the form of a folding bellows 18. The uppermost region of the second part 16 forms a collar, which extends upward beyond the first part 11 and has a ring or bead 17 engaging over at least an upper circumferential rib 3 on the neck 2. A reinforcing ring 19 may be inserted in the vicinity of the dispensing opening 7.

The delivery chamber 20 is reduced in size by virtue of the lower region of the second part 16, the lower region containing the second non-return valve 8, being raised, wherein the folding bellows 18 is compressed. This takes place by a driver sleeve 25, which acts on the metering pump 5, around the dispensing opening 7, by way of an annular flange.

If the driver sleeve 25 is raised, then medium enclosed in the delivery chamber 20—air in the event of initial actuation—is pushed out through the dispensing opening 7 via the valve 8, since the first non-return valve 6 blocks the path into the container 1.

A non-illustrated restoring device, which can act on the folding bellows 18, and the elastic restoring action of the folding bellows, increase the size of the delivery chamber 20, wherein the second non-return valve 8 closes in an air-tight manner and the first non-return valve 6 opens, so that medium can flow into the delivery chamber 20 out of the container 1.

In order that air can flow into the container 1, which should not be compressed by external pressure, when the medium is extracted by suction into the delivery chamber 20, an air path 14 is made on the neck 2. The neck 2 has at least one groove-like recess 9, which interrupts the circumferential ribs 3, 4, extending on it from top to bottom, and merging into a recess 10 in the end surface of the neck 2. The mouth opening of the recess 10 on the inner surface of the neck 2 is covered over by the sealing lip 12 of the first part 11 of the metering pump, the sealing lip detaching itself from the inner surface of the neck as a portion of the medium is extracted by suction out of the container 1, so that the air which is required can flow into the container 1 via the air path 14.

The container 1 has protrusions 15, which project outward on the neck 2 and interact with corresponding counterpart elements 32 on a plug-in opening 27 for the container neck 2 on a holder 21. It is preferable to provide three protrusions 15 and three counterpart elements 32, each distributed non-uniformly over the circumference, so that just one insertion position is possible. A rotary movement locks the container 1 with metering pump 5 in the holder 21, and the dispenser is ready for use.

Figure 3:
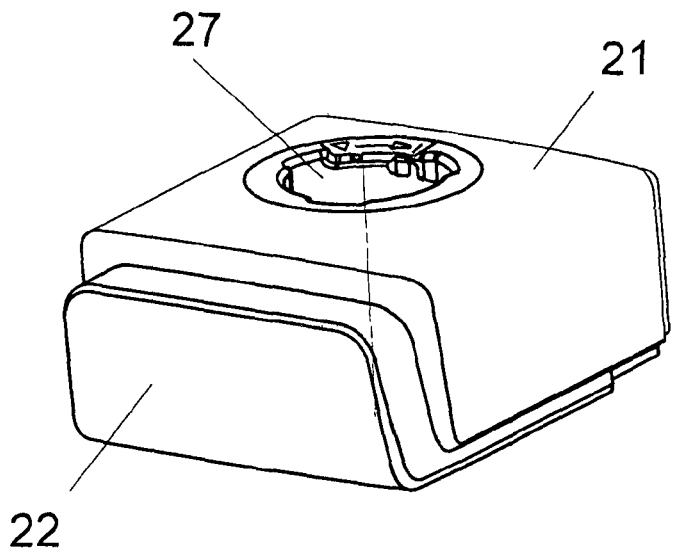
FIG. 3 is a diagrammatic, perspective view of the dispenser without the container.
Figure 4:
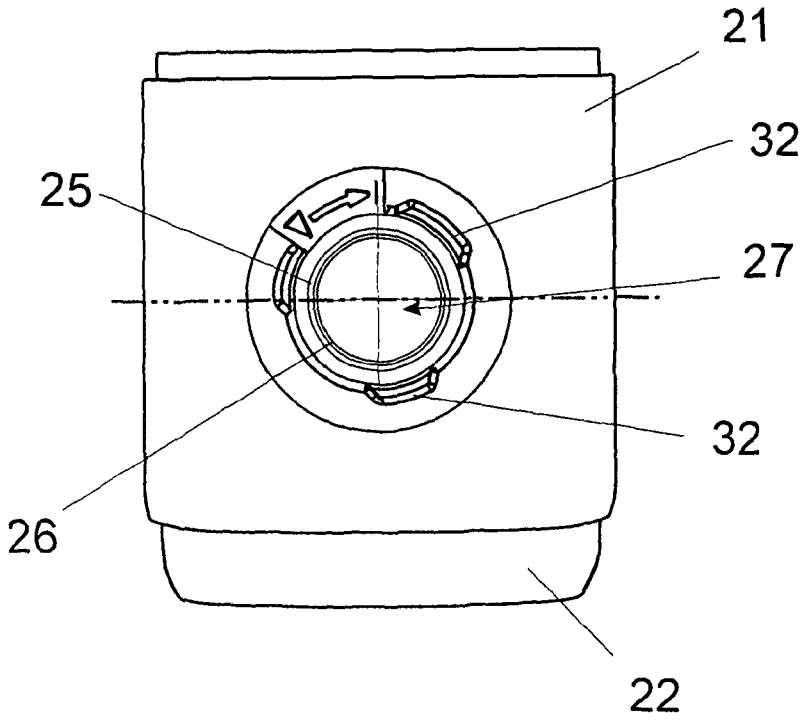
FIG. 4 is a plan view of the dispenser without the container.

In the holder 21, a drawer-like actuating element 22 for the metering pump 5 can be displaced horizontally in relation to a spring 24, wherein the actuating element 22 extends more or less over the entire width and height of the holder 21, as can be seen, in particular, from FIGS. 1 and 3. Vertical crosspieces 33 in the interior of the actuating element 22 each have a slot 34 with a horizontal and an obliquely upwardly sloping end portion 35, of which the parallel peripheries form a ramp 23 in each case (see FIG. 6). Vertical guides 29 with slots 36 are provided in the interior of the holder 21, and each cooperate with a slot 34. For accommodating and actuating the delivery pump 2, as has been mentioned, the driver sleeve 25 can be displaced vertically approximately in the center of the holder 21. The driver sleeve 25 has provided on it two outwardly projecting stubs 28 or the like, which extend through the slots 36 of the vertical guides 29 of the holder 21 and slots 34 of the vertical crosspieces 33 of the actuating element 22.

Figure 5:
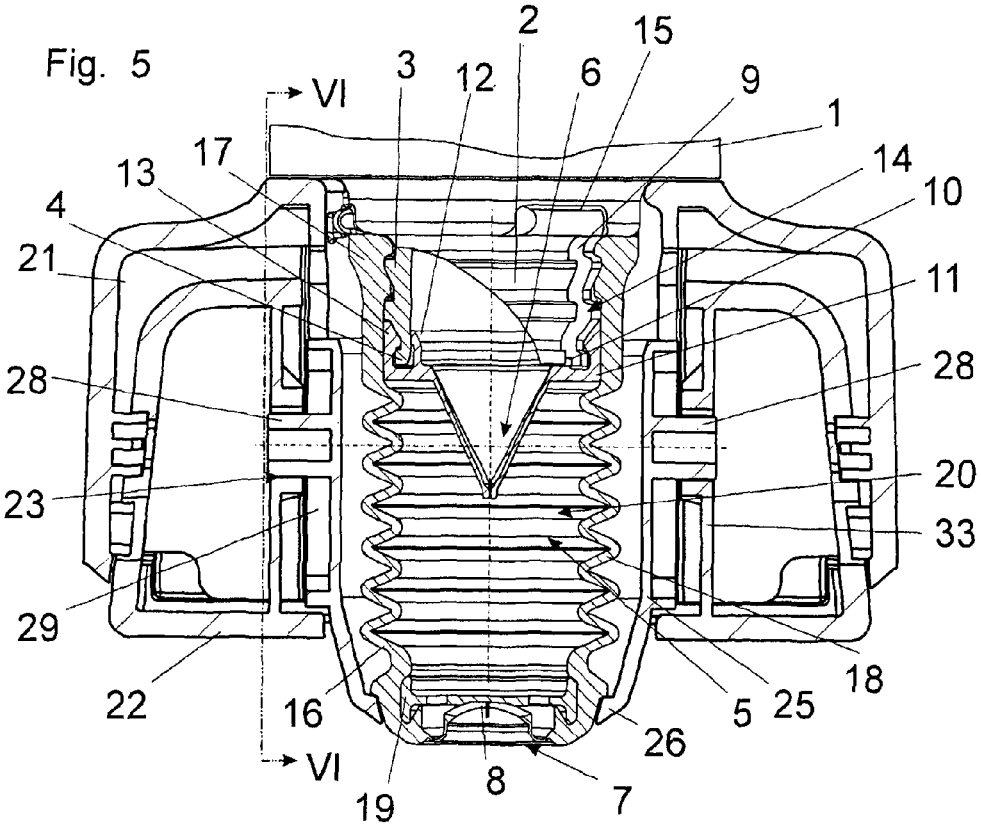
FIG. 5 is an enlarged scale, vertical sectional view through the dispenser rotated through 90° in relation to FIG. 2.
Figure 6:
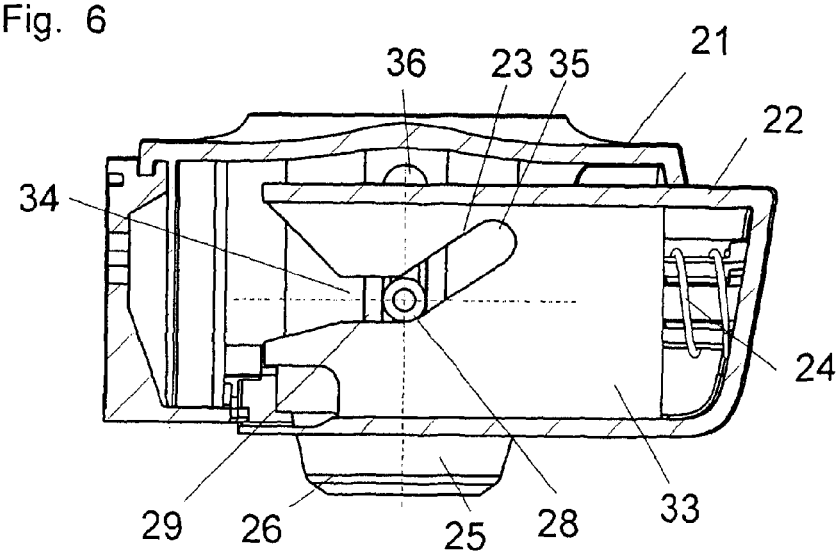
FIG. 6 is a sectional view taken along the line VI-VI shown in FIG. 5.
Figure 7:
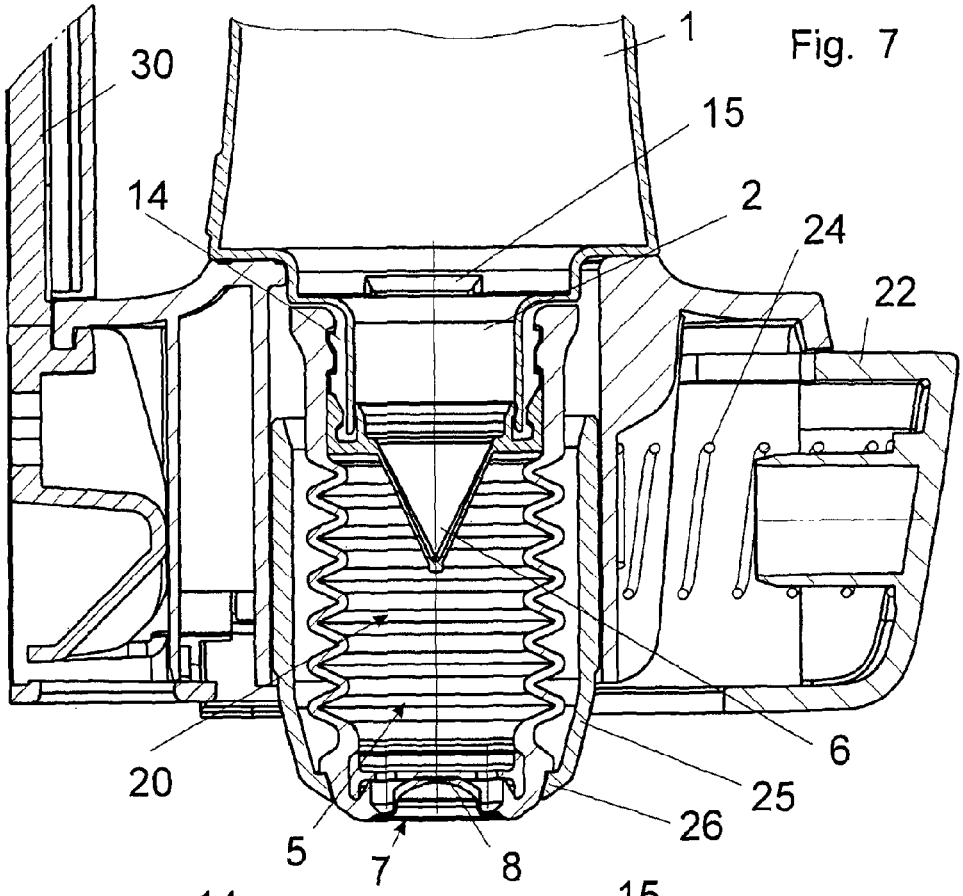
FIGS. 7 and 8 are sectional views showing two positions of a metering pump in the illustration according to FIG. 2.

FIGS. 5 and 7 show the metering pump 5 in the rest position with the delivery chamber 20 at its maximum, wherein the stubs 28 are located in the horizontal portions of the slots 34 (FIG. 6). If pressure is applied to the actuating element 22, then each lower ramp 23 of the oblique end portion 35 shifts the associated stub 28 upward and the driver sleeve 25 is raised in the vertical guide 29, as a result of which the delivery chamber 20 is reduced in size and a portion of the medium is forced out of the valve 8.

Figure 8:
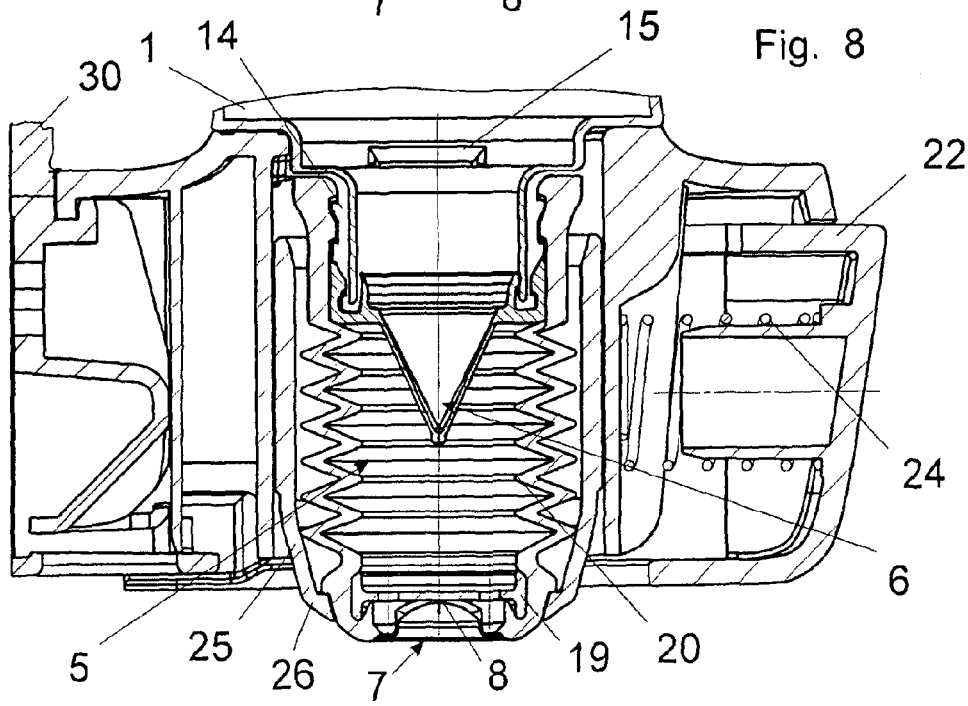

FIG. 8 shows the end position from which, when the actuating element 22 is released, under the action of the spring 24, the restoring action of the driver sleeve 25 in the downward direction is initiated and medium is taken in through the valve 6.

A side support 30 also extends upward from the holder 21, and has an upper ring 31 arranged on it, the upper ring 31 additionally securing the container 1 in the upper region against being accidentally pushed away or tilted. The upper ring 31 has, in particular, an approximately rectangular cross section and consists of a transparent plastics material, and therefore it is possible for information, for example on a stick-on carrier, to be provided on the inner side of the ring 31 so as to be safeguarded against external contact.

On the upper side, the container 1 may have a covering 37, beneath which it is also possible to provide an air-admission opening. Once the container 1 has been inserted into the holder 21, the covering 37 can be plugged on, wherein the air-admission opening is pierced.

The invention claimed is:

1. A dispenser for a liquid media or a pasty media, the dispenser comprising:

a metering pump having an upper inlet, a bottom with a dispensing opening formed therein, and a delivery chamber;

an exchangeable container disposed in an upended state and having an underside on which underside said metering pump is disposed;

a holder for said exchangeable container;

an actuating element for said metering pump disposed on said holder such that said actuating element being displaceable in a drawer-like manner in said holder and having a ramp;

a first non-return valve disposed at said upper inlet into said metering pump;

a driver; and a second non-return valve disposed at said dispensing opening at said bottom of said metering pump, said second non-return valve constructed for being raised to reduce a size of said delivery chamber, said second non-return valve being assigned said driver, said driver being guided upward in said holder and can be shifted by said ramp.

2. The dispenser according to claim 1, wherein said driver is a lower annular flange of a sleeve, which is guided in a displaceable manner in said holder and acts on said metering pump around said second non-return valve.

3. The dispenser according to claim 1, wherein said actuating element extends approximately over an entire width of said holder.

4. The dispenser according to claim 1, wherein said metering pump is disposed in a non-releasable manner on said exchangeable container.

5. A dispenser for a liquid media or a pasty media, the dispenser comprising:

a metering pump having an upper inlet, a bottom with a dispensing opening formed therein, and a delivery chamber;

an exchangeable container disposed in an upended state and having an underside on which underside said metering pump is disposed;

a holder for said exchangeable container;

an actuating element for said metering pump disposed on said holder, said actuating element disposed in a displaceable manner in said holder and having a ramp;

a first non-return valve disposed at said upper inlet into said metering pump;

a driver; and a second non-return valve disposed at said dispensing opening at said bottom of said metering pump, said second non-return valve constructed for being raised to reduce a size of said delivery chamber, said second non-return valve being assigned said driver, said driver being guided upward in said holder and can be shifted by said ramp;

said driver is a lower annular flange of a sleeve, which is guided in a displaceable manner in said holder and acts on said metering pump around said second non-return valve;

an inner stiffening ring; and said metering pump having a folding bellows, which is provided with said inner stiffening ring in an abutment region of said lower annular flange of said sleeve.

6. The dispenser according to claim 5, wherein said second non-return valve is formed in one piece with said folding bellows and has a slotted exit opening.

* * * * *